US009741475B2

(12) United States Patent
Elder et al.

(10) Patent No.: US 9,741,475 B2
(45) Date of Patent: Aug. 22, 2017

(54) FLANGE ATTACHMENT

(71) Applicant: ABB Technology AG, Zurich (CH)

(72) Inventors: Lonnie C. Elder, Jackson, TN (US); Jan Czyzewski, Adliswil (CH)

(73) Assignee: ABB SCHWEIZ AG, Baden (CH)

( * ) Notice: Subject to any disclaimer, the term of this patent is extended or adjusted under 35 U.S.C. 154(b) by 200 days.

(21) Appl. No.: 14/496,091

(22) Filed: Sep. 25, 2014

(65) Prior Publication Data

US 2016/0093422 A1 Mar. 31, 2016

(51) Int. Cl.

| | |
|---|---|
| ***H01B 17/58*** | (2006.01) |
| ***H01B 17/30*** | (2006.01) |
| ***H01B 17/26*** | (2006.01) |
| *H01B 17/16* | (2006.01) |

(52) U.S. Cl.

CPC ..... *H01B 17/583* (2013.01); *H01B 17/265* (2013.01); *H01B 17/30* (2013.01); *H01B 17/16* (2013.01)

(58) Field of Classification Search

CPC ..... H01B 17/583; H01B 17/30; H01B 17/58; H01B 17/26; H01B 17/16; H01B 17/301; H01B 17/265; H01B 17/32; H01B 17/325; H01F 27/04

USPC ..... 174/652, 163 R, 158 R, 142, 152 R, 174/137 R, 650, 659, 660, 665, 154

See application file for complete search history.

(56) References Cited

U.S. PATENT DOCUMENTS 1,511,534 A * 10/1924 Steinberger ..... H01B 17/28 174/142
1,915,838 A 6/1933 Spring
2,088,502 A * 7/1937 Arnold ..... H01B 17/26 174/152 R
3,230,301 A * 1/1966 Sonnenberg ..... H01B 17/28 174/143
4,670,625 A 6/1987 Wood et al.
7,964,799 B2 6/2011 Isberg et al.

FOREIGN PATENT DOCUMENTS

| | | |
|---|---|---|
| DE | 396714 | 6/1924 |
| DE | 897436 | 11/1953 |
| GB | 242942 | 2/1926 |

OTHER PUBLICATIONS

Int. Search Report/Written Opinion cited in PCT Application No. PCT/US2015/050389 dated Feb. 17, 2016, 21 pgs.

* cited by examiner

*Primary Examiner* — Dimary Lopez Cruz

(57) ABSTRACT

An insulating device includes a body portion including a first surface feature extending between a first surface end and a second surface end. The first surface end defines a first surface cross-sectional size. The second surface end defines a second surface cross-sectional size. The second surface cross-sectional size is less than the first surface cross-sectional size. The body portion includes a second surface feature extending between a third surface end and a fourth surface end. The third surface end defines a third surface cross-sectional size. The fourth surface end defines a fourth surface cross-sectional size. The fourth surface cross-sectional size is less than the third surface cross-sectional size. The insulating device includes a flange portion having a flange wall. The flange wall includes a first mating portion that engages the first surface feature and a second mating portion that engages the second surface feature of the body portion.

29 Claims, 9 Drawing Sheets

FLANGE ATTACHMENT

BACKGROUND

A bushing is an electrically insulating device that allows an electrical conductor under voltage to pass through a surface and/or a grounded barrier. The bushing can be attached to a barrier, such as a wall or a tank.

SUMMARY

This summary is provided to introduce a selection of concepts in a simplified form that are further described below in the detailed description. This summary is not intended to identify key factors or essential features of the claimed subject matter, nor is it intended to be used to limit the scope of the claimed subject matter.

According to an aspect, an insulating device comprises a body portion extending along a body axis. The body portion comprises a first surface feature, at a first location along the body axis, extending between a first surface end and a second surface end. The first surface end defines a first surface cross-sectional size. The second surface end defines a second surface cross-sectional size. The second surface cross-sectional size is less than the first surface cross-sectional size. The body portion comprises a second surface feature, at a second location along the body axis, extending between a third surface end and a fourth surface end. The third surface end defines a third surface cross-sectional size. The fourth surface end defines a fourth surface cross-sectional size. The fourth surface cross-sectional size is less than the third surface cross-sectional size. The insulating device comprises a flange portion extending along a flange axis that is substantially parallel to the body axis. The flange portion comprises a flange wall defining a flange opening into which the body portion is received. The flange wall of the flange portion comprises a first mating portion at a first location along the flange axis. The first mating portion can engage the first surface feature of the body portion. The flange portion comprises a second mating portion at a second location along the flange axis. The second mating portion can engage the second surface feature of the body portion.

According to another aspect, an insulating device comprises a body portion extending along a body axis. The body portion comprises a first surface feature, at a first location along the body axis, extending between a first surface end and a second surface end. The first surface end defines a first surface cross-sectional size. The second surface end defines a second surface cross-sectional size. The second surface cross-sectional size is less than the first surface cross-sectional size. The insulating device comprises a flange portion extending along a flange axis that is substantially parallel to the body axis. The flange portion comprises a flange wall defining a flange opening into which the body portion is received. The flange wall of the flange portion comprises a first mating portion at a first location along the flange axis. The first mating portion can engage the first surface feature of the body portion. The insulating device comprises an attachment structure defining an attachment opening into which the body portion is received. A first side of the attachment structure can engage the body portion. A second side of the attachment structure can engage the flange portion. The attachment structure is configured to promote engagement of the first mating portion with the first surface feature.

According to another aspect, an insulating device comprises a body portion extending along a body axis. The body portion has an outer surface comprising a first projection portion. The first projection portion projects in a projection direction that is substantially perpendicular to the body axis. The insulating device comprises a flange portion extending along a flange axis that is substantially parallel to the body axis. The flange portion comprises a flange wall defining a flange opening into which the body portion is received. An inner surface of the flange wall defines a first projection opening. The first projection opening of the flange portion receives the first projection portion of the body portion when the body portion is received within the flange opening of the flange portion such that rotational movement of the flange portion with respect to the body portion about the flange axis and rotational movement of the body portion with respect to the flange portion about the body axis is limited.

To the accomplishment of the foregoing and related ends, the following description and annexed drawings set forth certain illustrative aspects and implementations. These are indicative of but a few of the various ways in which one or more aspects may be employed. Other aspects, advantages, and novel features of the disclosure will become apparent from the following detailed description when considered in conjunction with the annexed drawings.

FIGURES

The application is illustrated by way of example and not limitation in the figures of the accompanying drawings, in which like references generally indicate similar elements and in which.

DESCRIPTION

Figure 1:
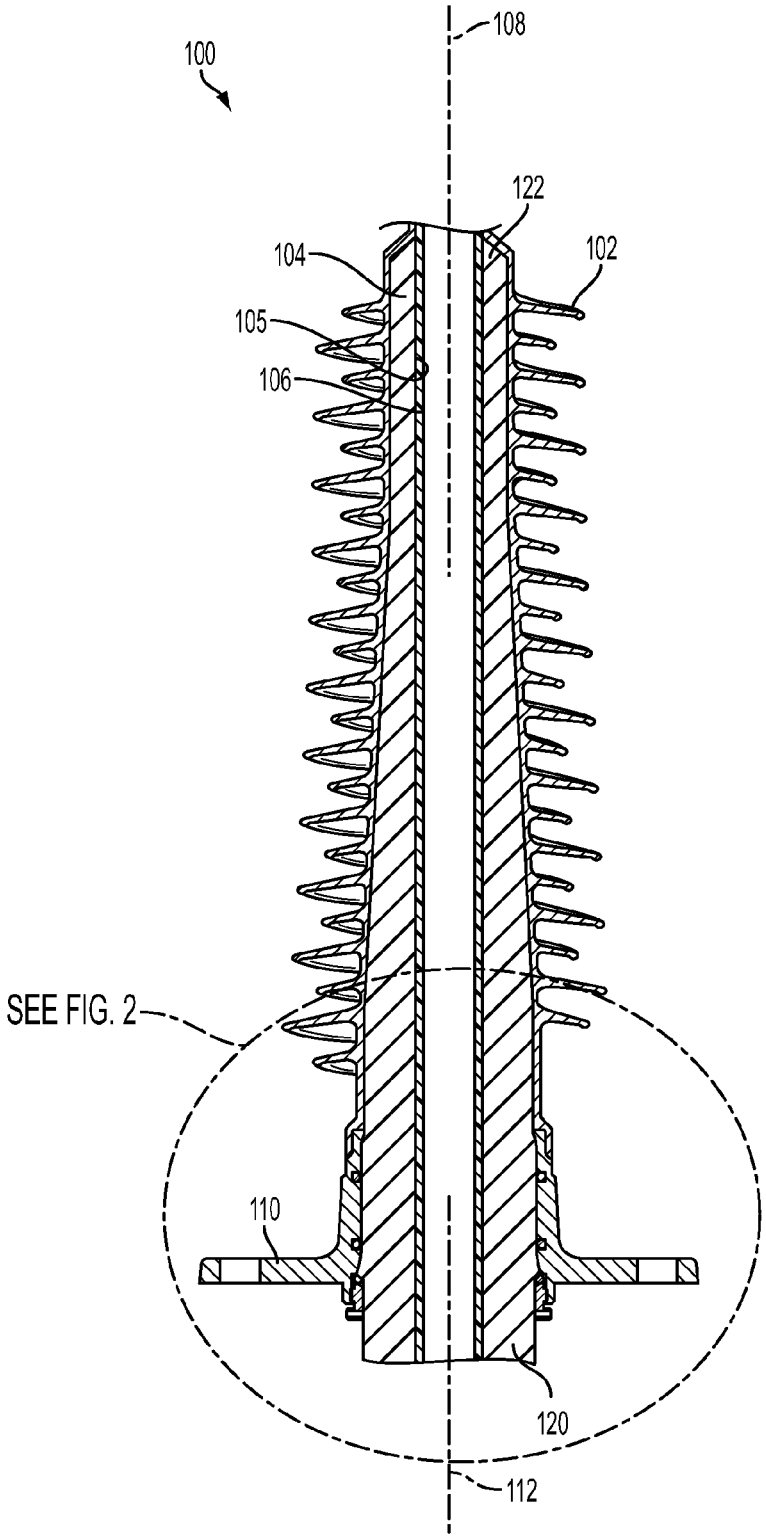
FIG. 1 illustrates an example portion of an example insulating device.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are illustrated in block diagram form in order to facilitate describing the claimed subject matter.

FIG. 1 is an illustration of an example insulating device 100. In general, the insulating device 100 can be used for electrically insulating an electrically conductive material, such as an electrical conductor (e.g., wire or the like). The insulating device 100 allows for the electrical conductor to pass through a barrier (e.g., conducting, non-conducting, etc.), such as walls or the like. It will be appreciated that the insulating device 100 of FIG. 1 is illustrated as sectioned off, such that a cross-section of the insulating device 100 is illustrated for ease of discussion. In operation, however, the insulating device 100 is generally not sectioned off, such that inner portions of the insulating device 100 are not normally visible/exposed.

The insulating device 100 may include one or more sheds 102. The sheds 102 can be positioned at an outer location of a body portion 104 of the insulating device 100. The sheds 102 can extend generally around the body portion 104 while projecting outwardly, such as by extending helically and/or annularly around the body portion 104. The sheds 102 can provide at least some degree of weather protection to the body portion 104, such as when the insulating device 100 is located at least partially in an outdoor environment, for example.

The insulating device 100 may include a conduit 106 arranged towards a center of the insulating device 100. In an example, the conduit 106 comprises a generally hollow, elongated tube into which an electrical conductor may be received. The conduit 106 can, for example, be arranged/positioned within a body opening 105 of the body portion 104. In other examples, the insulating device 100 may include a conductor instead of the conduit 106 and/or neither a conductor nor the conduit 106.

Turning to the body portion 104, the body portion 104 may extend along a body axis 108. In the illustrated example, the body axis 108 is generally linear, though in other examples, the body axis 108 may have at least some degree of bend, curvature, or the like, such that the body portion 104 is not limited to extending linearly. In an example, the body portion 104 can extend between a first end 120 (e.g., bottom end in this example) and a second end 122 (e.g., top end in this example).

The body portion 104 can be attached with respect to a flange portion 110. The flange portion 110 can extend along a flange axis 112 that is substantially parallel to the body axis 108. In some examples, the flange axis 112 and the body axis 108 are co-linear, such that the body portion 104 and the flange portion 110 are coaxial with respect to each other. In other examples, the flange portion 110 can be axially offset from the body portion 104, such that the body axis 108 and the flange axis 112 are not co-linear, but may still extend substantially parallel to each other.

Figure 2:
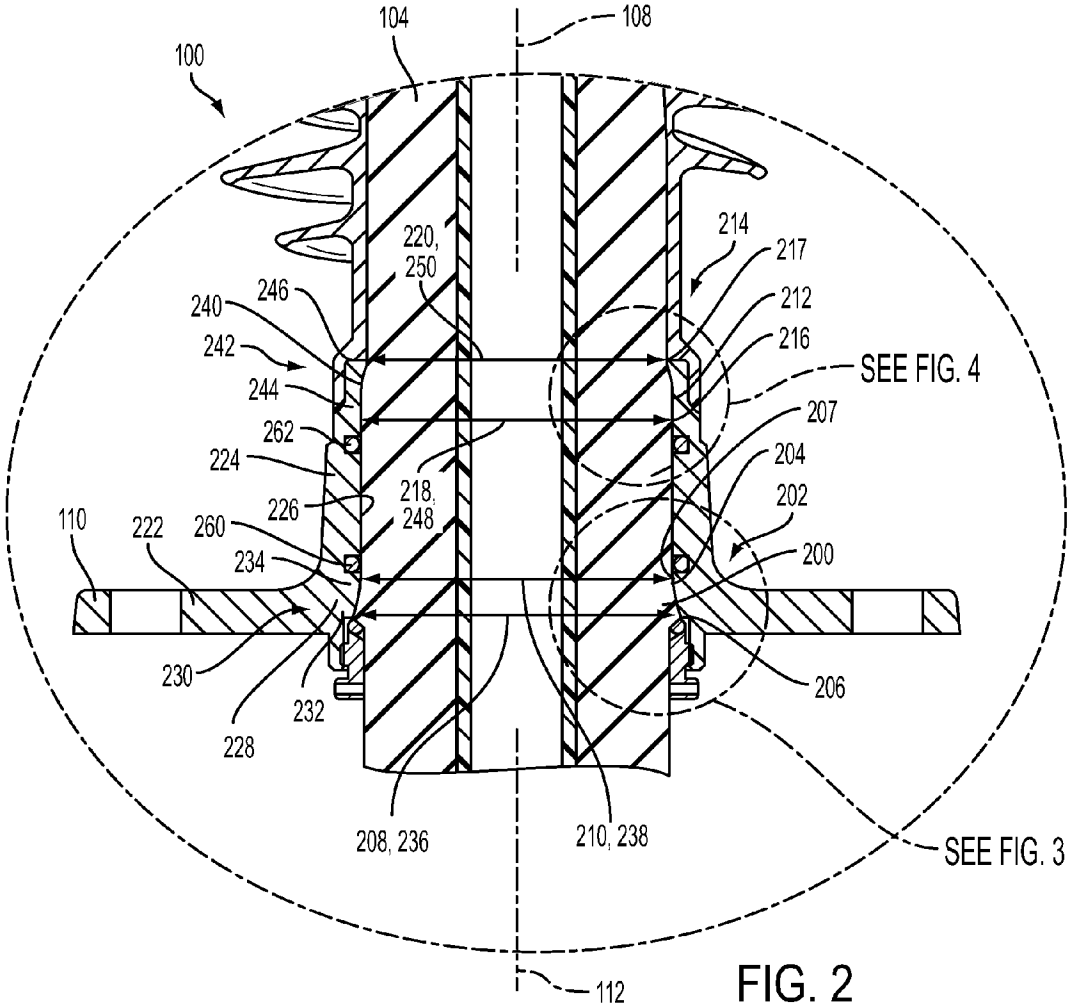
FIG. 2 illustrates an example portion of an example insulating device.

Turning to FIG. 2, the body portion 104 and the flange portion 110 are illustrated and can be described in more detail. The body portion 104 comprises any number of materials. In general, the body portion 104 may include a non-electrically conductive material. For example, the body portion 104 may include a composite material including a resin impregnated synthetic, such as an epoxy-based material.

The body portion 104 can include a first surface feature 200. The first surface feature 200 is positioned at a first location 202 along the body axis 108. The first surface feature 200 can be formed at an outer surface 204 of the body portion 104, such that the first surface feature 200 can engage the flange portion 110.

The first surface feature 200 can extend between a first surface end 206 and a second surface end 207 along the body axis 108. The first surface end 206 of the first surface feature 200 can define a first surface cross-sectional size 208. The second surface end 207 of the first surface feature 200 can define a second surface cross-sectional size 210. In this example, the second surface cross-sectional size 210 is less than the first surface cross-sectional size 208. As such, the first surface feature 200 has a generally tapered shape with a decreasing cross-sectional size from the first surface end 206 to the second surface end 207. In some examples, such as the example of FIG. 2, the outer surface 204 of the first surface feature 200 can be generally linear in cross-section, while in other examples, the outer surface 204 may have at least some degree of curvature between the first surface end 206 and the second surface end 207. As used herein, by being linear in cross-section, a surface (e.g., an inner surface and/or an outer surface) can extend generally linearly along an axis (e.g., the body axis 108 and/or the flange axis 112) with little or no bends, curves, in this axial direction. As such, surfaces that are linear in cross-section may have a shape that is at least partially conical, in that the surface(s) (e.g., an inner surface and/or an outer surface) tapers smoothly and linearly along the axis (e.g., the body axis 108 and/or the flange axis 112) with an increasing, decreasing, or constant cross-sectional size.

The body portion 104 can include a second surface feature 212. The second surface feature 212 is positioned at a second location 214 along the body axis 108. The second surface feature 212 can be formed at the outer surface 204 of the body portion 104, such that the second surface feature 212 can engage the flange portion 110.

The second surface feature 212 can extend between a third surface end 216 and a fourth surface end 217 along the body axis 108. The third surface end 216 can define a third surface cross-sectional size 218. The fourth surface end 217 can define a fourth surface cross-sectional size 220. In this example, the fourth surface cross-sectional size 220 is less than the third surface cross-sectional size 218. As such, the second surface feature 212 has a generally tapered shape with a decreasing cross-sectional size from the third surface end 216 to the fourth surface end 217. In some examples, such as in the example of FIG. 2, the outer surface 204 of the second surface feature 212 can be generally linear in cross-section, while in other examples, the outer surface 204 may have at least some degree of curvature between the third surface end 216 and the fourth surface end 217.

In the illustrated example, the first surface end 206, the second surface end 207, the third surface end 216, and the fourth surface end 217 are arranged consecutively along the body axis 108. For example, the second surface end 207 is located between the first surface end 206 and the third surface end 216. The third surface end 216 may be located between the second surface end 207 and the fourth surface end 217.

Turning now to the flange portion 110, the flange portion 110 can include a fastening portion 222. The fastening portion 222 can project outwardly in a direction that is generally perpendicular to the flange axis 112. In some examples, the fastening portion 222 can be attached to a wall, surface, or the like. As such, the fastening portion 222 provides for the insulating device 100 to be attached to the wall, surface, etc.

The flange portion 110 can include a flange wall 224. The flange wall 224 can be attached to and/or formed with the fastening portion 222. The flange portion 110, including the fastening portion 222 and the flange wall 224, can include any number of materials, including metal materials, for example. In general, the flange wall 224 can extend along the flange axis 112. The flange wall 224 defines a flange opening 226 into which the body portion 104 is received.

The flange wall 224 of the flange portion 110 comprises a first mating portion 228 at a first location 230 along the flange axis 112. The first mating portion 228 can engage and contact the first surface feature 200 of the body portion 104. In this example, the first mating portion 228 extends between a first mating end 232 and a second mating end 234. The first mating portion 228 can surround a lower portion of the body portion 104.

The first mating end 232 of the first mating portion 228 can define a first mating cross-sectional size 236. The second mating end 234 of the first mating portion 228 can define a second mating cross-sectional size 238. In this example, the second mating cross-sectional size 238 may be less than the first mating cross-sectional size 236. As such, the first mating portion 228 has a generally tapered shape with a decreasing cross-sectional size from the first mating end 232 to the second mating end 234. In some examples, such as in the example of FIG. 2, an inner surface of the first mating portion 228 can be generally linear in cross-section, while in other examples, the inner surface may have at least some degree of curvature between the first mating end 232 and the second mating end 234.

In this example, the first surface feature 200 and the first mating portion 228 can have a generally matching shape. For example, the first mating cross-sectional size 236 may be substantially equal to the first surface cross-sectional size 208. In this example, the second mating cross-sectional size 238 may be substantially equal to the second surface cross-sectional size 210.

In an alternative example, the mating cross-sectional sizes 236, 238 may not be equal to the corresponding surface cross-sectional sizes 208, 210, but, rather, may be dimensioned such that a first surface opening angle 290 of the first surface feature 200 (e.g., at the tapered surface of the first surface feature 200) is substantially equal to a first mating opening angle 292 of the first mating portion 228 (e.g., at the tapered surface of the first mating portion 228). In an example (illustrated in FIG. 3), the first surface opening angle 290 is defined between the first surface feature 200 and a reference axis 291. The reference axis 291 may be substantially parallel to the body axis 108 and/or the flange axis 112, with the reference axis 291 extending substantially vertically in this example. The first mating opening angle 292 is defined between the first mating portion 228 and the reference axis 291. In the illustrated example, the first surface opening angle 290 and the first mating opening angle 292 are acute angles, such as by being in a range of about 5 degrees to about 45 degrees.

The flange wall 224 of the flange portion 110 comprises a second mating portion 240 at a second location 242 along the flange axis 112. The second mating portion 240 can engage and contact the second surface feature 212 of the body portion 104. In this example, the second mating portion 240 extends between a third mating end 244 and a fourth mating end 246. The second mating portion 240 can surround an upper portion of the body portion 104.

The third mating end 244 can define a third mating cross-sectional size 248. The fourth mating end 246 can define a fourth mating cross-sectional size 250. In this example, the fourth mating cross-sectional size 250 may be less than the third mating cross-sectional size 248. As such, the second mating portion 240 has a generally tapered shape with a decreasing cross-sectional size from the third mating end 244 to the fourth mating end 246. In some examples, such as in the example of FIG. 2, an inner surface of the second mating portion 240 can be generally linear in cross-section, while in other examples, the inner surface may have at least some degree of curvature between the third mating end 244 and the fourth mating end 246.

In this example, the second surface feature 212 and the second mating portion 240 can have a generally matching shape. For example, the third mating cross-sectional size 248 may be substantially equal to the third surface cross-sectional size 218. In this example, the fourth mating cross-sectional size 250 may be substantially equal to the fourth surface cross-sectional size 220. It will be appreciated that the cross-sectional sizes 208, 210, 218, 220, 236, 238, 248, 250 described herein comprises any number of measurements, including diameters (e.g., for when the sections of the body portion 104 and the flange portion 110 are generally axisymmetric), distances across (e.g., for when the body portion 104 and the flange portion 110 are generally square/rectangular), area, etc. In this example, the cross-sectional sizes 208, 210, 218, 220, 236, 238, 248, 250 may include a diameter.

In an alternative example, the mating cross-sectional sizes 248, 250 may not be equal to the corresponding surface cross-sectional sizes 218, 220, but, rather, may be dimensioned such that a second surface opening angle 294 of the second surface feature 212 (e.g., at the tapered surface of the second surface feature 212) is substantially equal to a second mating opening angle 296 of the second mating portion 240 (e.g., at the tapered surface of the second mating portion 240). In an example (illustrated in FIG. 4), the second surface opening angle 290 is defined between the second surface feature 212 and the reference axis 291. The second mating opening angle 296 is defined between the second mating portion 240 and the reference axis 291. In this example, one or more of the cross-sectional sizes 236, 238, 248, 250 may be chosen such that the second surface opening angle 294 is substantially equal to the second mating opening angle 296.

In the illustrated example, the second surface opening angle 294 and the second mating opening angle 296 are acute angles, such as by being in a range of about 5 degrees to about 45 degrees. In an example, the first mating opening angle 292 is substantially equal to the second mating opening angle 296. In another example, the first surface opening angle 290 is substantially equal to the second surface opening angle 294.

In the illustrated example, the surface ends are arranged axially along the body axis 108 from the first end 120 to the second end 122 in the order of (e.g., from bottom to top) the first surface end 206, the second surface end 207, the third surface end 216 and the fourth surface end 217. For example, the second surface end 207 is located between the first surface end 206 and the third surface end 216. The third surface end 216 may be located between the second surface end 207 and the fourth surface end 217. In this example, the mating ends are arranged axially along the body axis 108 from the first end 120 to the second end 122 in the order of (e.g., from bottom to top) the first mating end 232, the second mating end 234, the third mating end 244, and the fourth mating end 246.

The flange portion 110 can include one or more compression structures 260, 262. The compression structures 260, 262 comprise any number of structures, such as O-rings, for example. The compression structures 260, 262 can be formed of a flexible/deformable material, such that the compression structures 260, 262 can compress, flex, etc. While two compression structures 260, 262 are illustrated, any number of compression structures 260, 262 can be provided.

In the illustrated example, the flange portion 110 includes a first compression structure 260 that may be supported adjacent and/or in proximity to the first mating portion 228. In such an example, the first compression structure 260 can abut/contact the first surface feature 200 on one side and the first mating portion 228 on an opposing side. The first compression structure 260 can thus assist in providing a seal between the body portion 104 and the flange portion 110.

In the illustrated example, the flange portion 110 includes a second compression structure 262 that may be supported adjacent and/or in proximity to the second mating portion 240. In such an example, the second compression structure 262 can abut/contact the second surface feature 212 on one side and the second mating portion 240 on an opposing side. The second compression structure 262 can thus assist in providing a seal between the body portion 104 and the flange portion 110.

Figure 3:
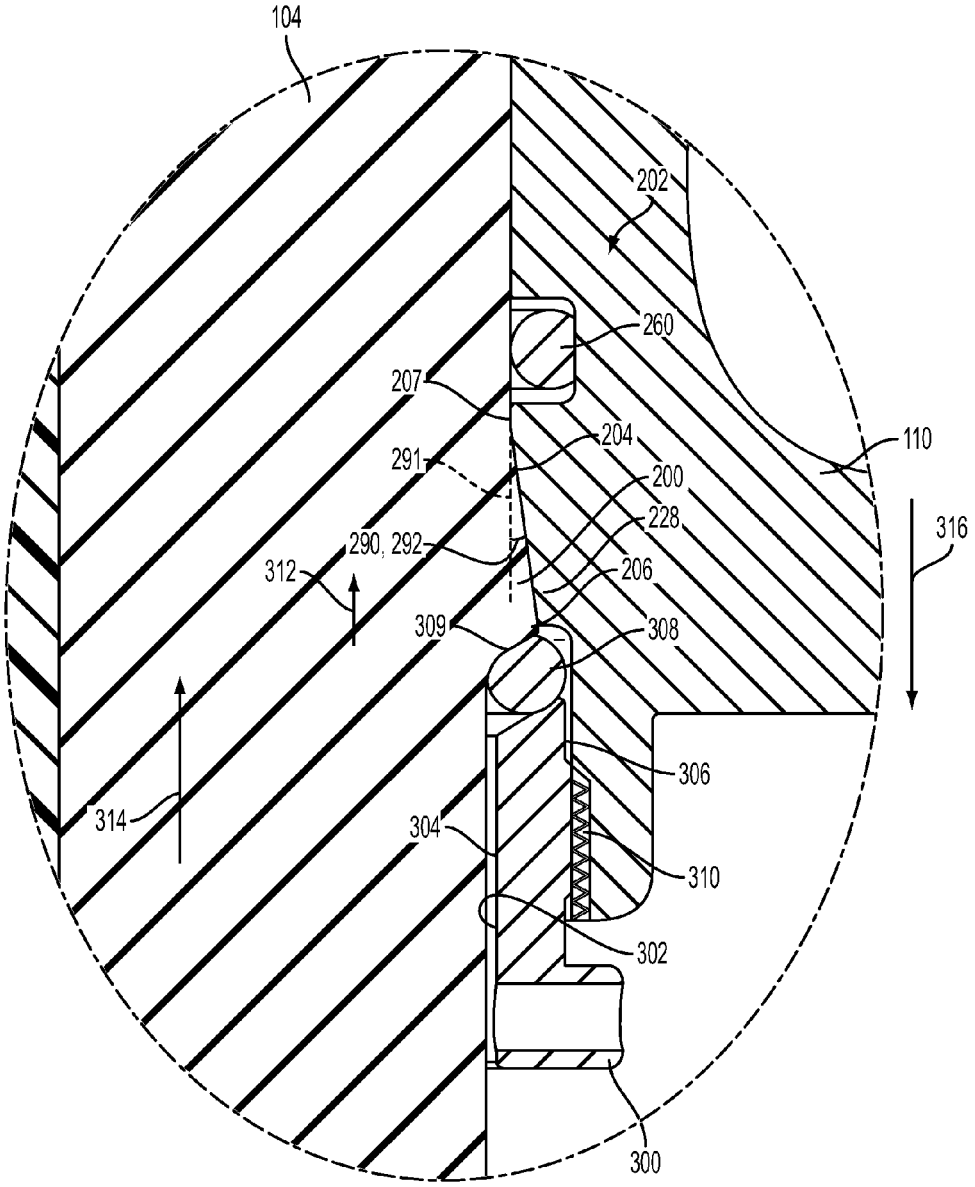
FIG. 3 illustrates an example portion of an example insulating device.

Turning now to FIG. 3, the insulating device 100 can include an attachment structure 300 for attaching the flange portion 110 and the body portion 104. The attachment structure 300 defines an attachment opening 302 into which the body portion 104 is received. In this example, the attachment structure 300 can have a generally matching cross-sectional shape (e.g., axisymmetric) as the body portion 104.

The attachment structure 300 can include a first side 304 and a second side 306. In this example, the first side 304 of the attachment structure 300 can engage the body portion 104. In this example, the second side 306 of the attachment structure 300 can engage the flange portion 110. The attachment structure 300 can be positioned adjacent the first surface end 206 of the first surface feature 200. By being adjacent, it is to be appreciated that the attachment structure 300 need not be in direct contact with a surface 309 of the first surface end 206 and, instead, one or more structures (e.g., O-rings, compression devices, etc.) may be positioned between the attachment structure 300 and the surface 309 the first surface end 206.

In this example, a compression structure (e.g., a third compression structure 308) can be positioned between the surface 309 of the first surface end 206 of the first surface feature 200 and the attachment structure 300. The third compression structure 308 may be generally identical in structure to the first compression structure 260 and the second compression structure 262 (e.g., but for differences in dimensions). For example, the third compression structure 308 may include an O-Ring.

The second side 306 of the attachment structure 300 can be attached to the flange portion 110. The attachment structure 300 can be attached in any number of ways. In the illustrated example, the second side 306 of the attachment structure 300 can threadingly engage 310 (location of threading engagement illustrated) the flange portion 110. To allow for this threading engagement 310, the second side 306 of the attachment structure 300 can include a male screw threading while the flange portion 110 can include a female screw threading. The attachment structure 300 can therefore be screwed into the flange portion 110.

In operation, the attachment structure 300 can threadingly engage 310 the flange portion 110. The attachment structure 300 can exert a force 312 (illustrated generically/schematically with arrowhead) upon the compression structure 308 in a direction along the body axis 108. Due to this force 312, the attachment structure 300 can promote engagement of the first mating portion 228 with the first surface feature 200. For example, the attachment structure 300, while threadingly engaging 310 the flange portion 110, can at least one of: move the body portion 104 in a first direction 314 along the body axis 108 or move the flange portion 110 in a second direction 316 along the body axis 108, opposite the first direction 314 to promote engagement of the first mating portion 228 with the first surface feature 200. Accordingly, despite variations in cross-sectional size due to manufacturing, the body portion 104 may still be relatively secure and in contact with the flange portion 110 (e.g., due to the tapered surface features and mating portions).

In response to this force applied by the attachment structure 300, the third compression structure 308 tends to be compressed between the attachment structure 300, the surface 309 of the first surface end 206 of the first surface feature 200 and/or the first mating portion 228. As such, the attachment structure 300, when tightened to a defined torque, and the third compression structure 308 tends to provide a consistent force leading to a consistent amount of friction between the flange portion 110 and the body portion 104 and between the body portion 104 and the third compression structure 308. While there may still be some variation in force applied to the third compression structure 308 (e.g., due to variations in surface roughness, lubrication of mating parts, etc.), this variation in force is reduced. An additional benefit/advantage is that by pressing the first mating portion 228, the flange portion 110 can fit fixed independently of dimensional tolerances of the body portion 104.

Figure 4:
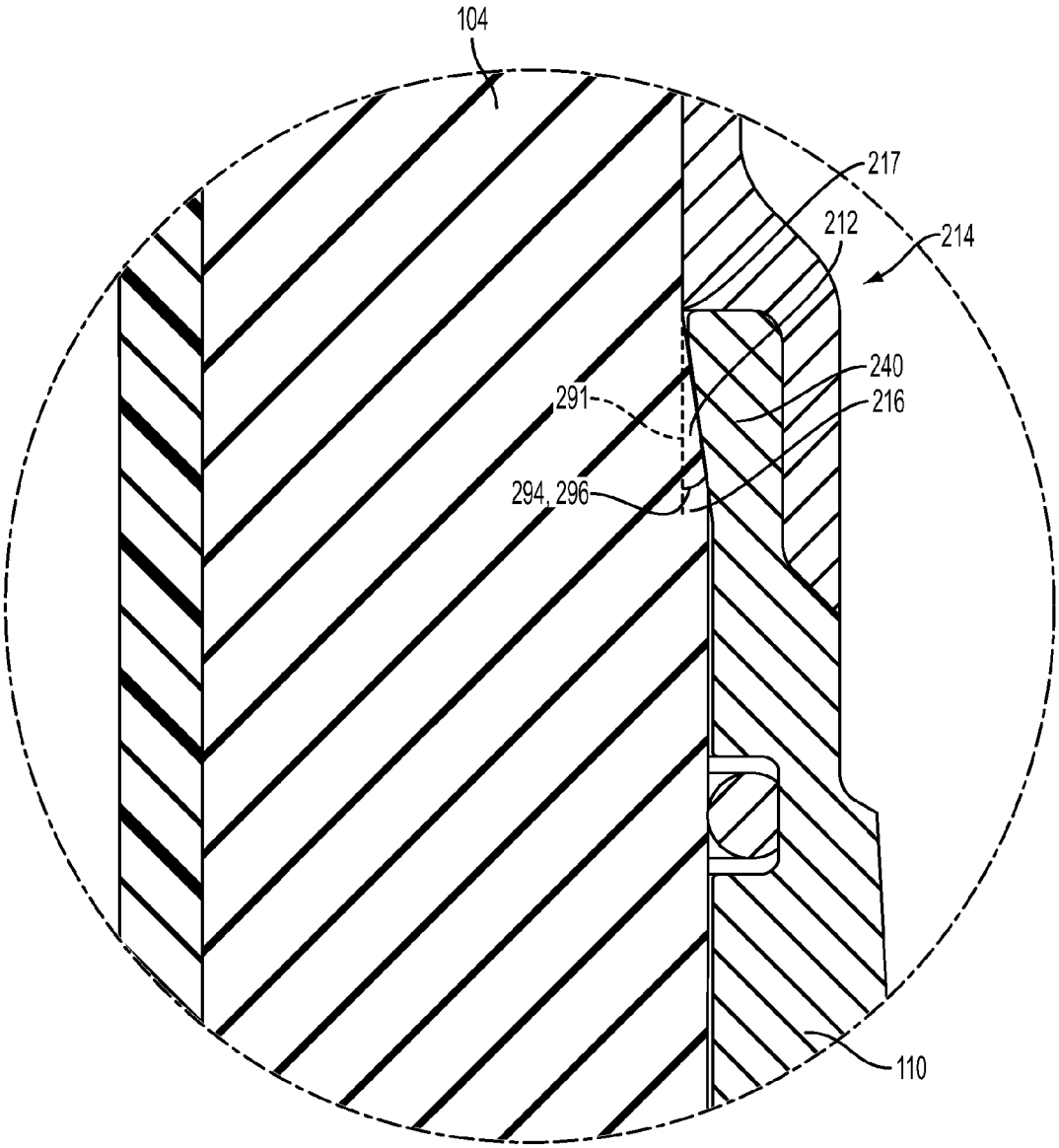
FIG. 4 illustrates an example portion of an example insulating device.

Referring now to FIGS. 2 to 4, attachment of the flange portion 110 to the body portion 104 can now be described. Initially, the flange portion 110 can receive the body portion 104 within the flange opening 226. The flange portion 110 can be moved in the second direction 316 with respect to the body portion 104. As the flange portion 110 moves in the second direction 316 (e.g., downwardly), the flange portion 110 can engage the surface features 200, 212 of the body portion 104. For example, as illustrated in FIG. 3, the first mating portion 228 can engage and contact the first surface feature 200. In some examples, a ring of curable elastomeric compound may be positioned between the first mating portion 228 and the first surface feature 200 to fill the gap therebetween and reduce motion, vibration, etc.

In addition to the first mating portion 228 contacting/engaging the first surface feature 200, the second mating portion 240 can likewise contact/engage the second surface feature 212. As illustrated in FIG. 4, the second mating portion 240 has a generally matching shape (e.g., tapered) as the second surface feature 212, such that the second mating portion 240 can contact/engage the second surface feature 212. In some examples, a ring of curable elastomeric compound may be positioned between the second mating portion 240 and the second surface feature 212 to fill the gap therebetween and reduce motion, vibration, etc.

With the flange portion 110 engaging the body portion 104 as described above, the attachment structure 300 can threadingly engage 310 the flange portion 110 to further promote engagement of the first mating portion 228 and the first surface feature 200. The attachment structure 300 can cause the body portion 104 to move in the first direction 314 along the body axis 108 and/or cause the flange portion 110 to move in the second direction 316 along the body axis 108, opposite the first direction 314.

The insulating device 100 provides a number of benefits. For example, due to the engagement between the first mating portion 228 and the first surface feature 200 and the second mating portion 240 and the second surface feature 212, the insulating device 100 provides a pair of contact/engagement points between the flange portion 110 and the body portion 104. As such, transverse motion of the body portion 104 with respect to the flange portion 110 is limited. Indeed, due to the relatively long length of the body portion 104 with respect to the relatively short length of the flange portion 110, providing for the pair of contact/engagement points between the flange portion 110 and the body portion 104, it is beneficial to reduce/limit transverse motion. This reduction in transverse motion may be due, in part, to a reduction in an annular gap between the flange portion 110 and the body portion 104 at these two contact/engagement points. It is noted that the area located axially between the first mating portion 228/the first surface feature 200 and the second mating portion 240/second surface feature 212 may have an annular gap. This annular gap allows for assembly and part tolerances, but may not affect/contribute to transverse motion of the body portion 104 with respect to the flange portion 110. In an example, axial displacement can depend on surface angles, diametrical tolerances, but is in the range of about 1.5 mm to about 2 mm, which can be well tolerated.

Figure 5:
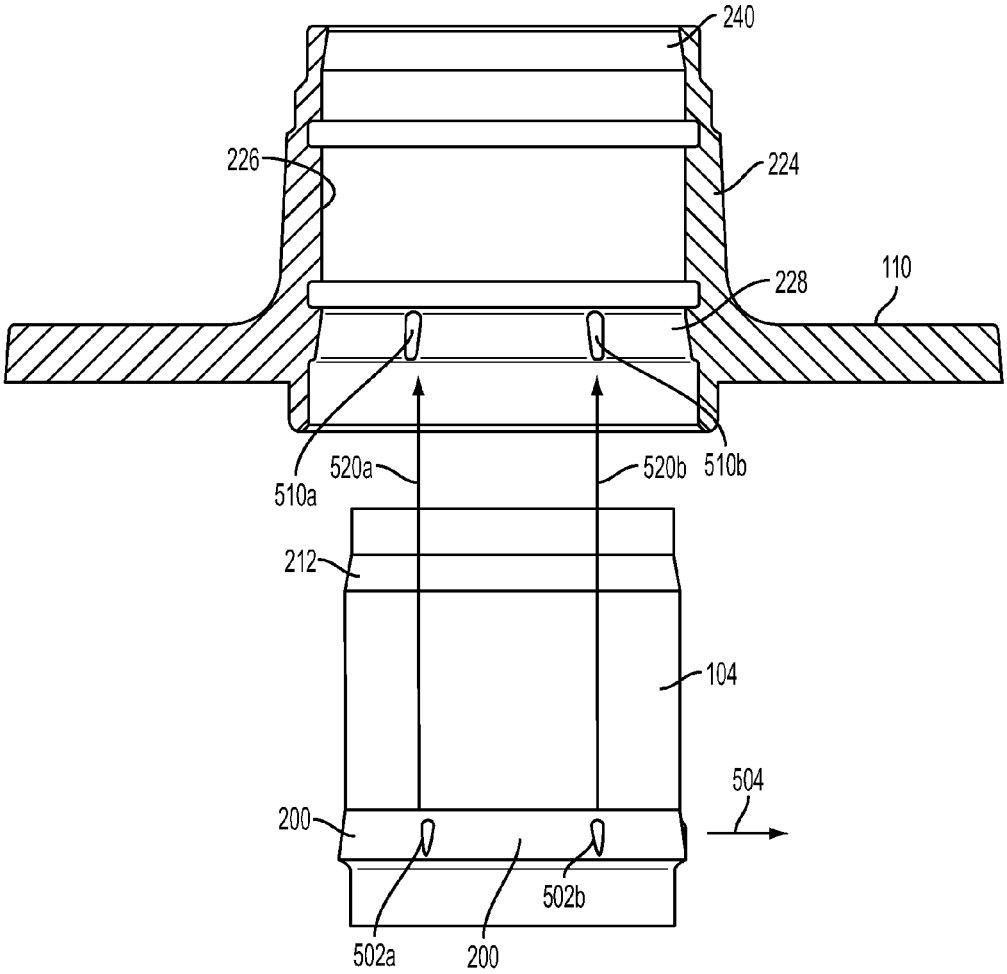
FIG. 5 illustrates an example portion of an example insulating device.

Turning to FIG. 5, the insulating device 100 is illustrated as being partially exploded in which the body portion 104 is detached from the flange portion 110. Likewise, for the purposes of illustration, FIG. 5 illustrates exterior/outer surfaces of the body portion 104 and interior/inner surfaces of the flange portion 110. In operation, however, the body portion 104 is attached to the flange portion 110 in a similar manner as described above with respect to FIGS. 1 to 4.

In this example, the outer surface 204 of the body portion 104 is illustrated. The outer surface 204 comprises a first projection portion 502. The first projection portion 502 may project in a projection direction that is substantially perpendicular to the body axis 108. In this example, the first projection portion 502 comprises a plurality of first projection portions 502 (e.g., 502*a*, 502*b*, etc.). However, the body portion 104 is not so limited. Rather, the body portion 104 may include any number of first projection portions 502 (e.g., one or more), and is not limited to the number illustrated herein.

The first projection portions 502 can be arranged on the outer surface 204 of the first surface feature 200. The first projection portions 502 can be spaced apart so as to extend around the first surface feature 200. In this example, the first projection portions 502 are generally elongated, such as by extending along the body axis 108. The first projection portions 502 are not limited to the illustrated locations or shape, however.

An inner surface of the flange wall 224 of the flange portion 110 can define a first projection opening 510. The first projection opening 510 can project in a direction that is substantially perpendicular to the body axis 108. In this example, the first projection opening 510 comprises a plurality of first projection opening 510 (e.g., 510*a*, 510*b*, etc.). However, the flange portion 110 is not so limited. Rather, the flange portion 110 may include any number of first projection openings 510 (e.g., one or more), and is not limited to the number illustrated herein.

The first projection openings 510 can be defined within the first mating portion 228. The first projection openings 510 can be spaced apart so as to extend around the first mating portion 228. In this example, the first projection openings 510 are generally elongated, such as by extending along the body axis 108. The first projection openings 510 are not limited to the illustrated locations or shapes. In general, engagement between the first projection openings 510 and the first projection portions 502 can limit the likelihood of "cam out" (e.g., inadvertent movement of the body portion 104 with respect to the flange portion 110).

In these examples, the first projection openings 510 can be sized, shaped, and located to substantially match a size, shape, and location of the first projection portions 502. For example, the first projection portions 502 are arranged on the first surface feature 200 while the first projection openings 510 are defined within the first mating portion 228. As such, the first projection openings 510 can receive the first projection portions 502 when the first surface feature 200 engages/contacts the first mating portion 228. However, such a location is not intended to be limiting, and, instead, the first projection portions 502 could instead be positioned on the second surface feature 212 while the first projection openings 510 could be defined within the second mating portion 240.

In operation, the first projection opening 510 of the flange portion 110 can receive (illustrated generically/schematically with arrowheads) the first projection portion 502 of the body portion 104 when the body portion 104 is received within the flange opening 226 of the flange portion 110. As such, rotational movement of the flange portion 110 with respect to the body portion 104 about the flange axis 112 is limited. Likewise, rotational movement of the body portion 104 with respect to the flange portion 110 about the body axis 108 is likewise limited. Accordingly, alignment of the body portion 104 with respect to the flange portion 110 is enhanced while movement, such as axial movement, rotational movement, etc. is limited/reduced. It is to be appreciated that the first projection portions 502 and the first projection openings 510 may be provided in a similar manner as described above as part of some or all of the insulating devices 100, 600, 700, 800, 900 described herein and illustrated with respect to FIGS. 1 to 9.

Figure 6:
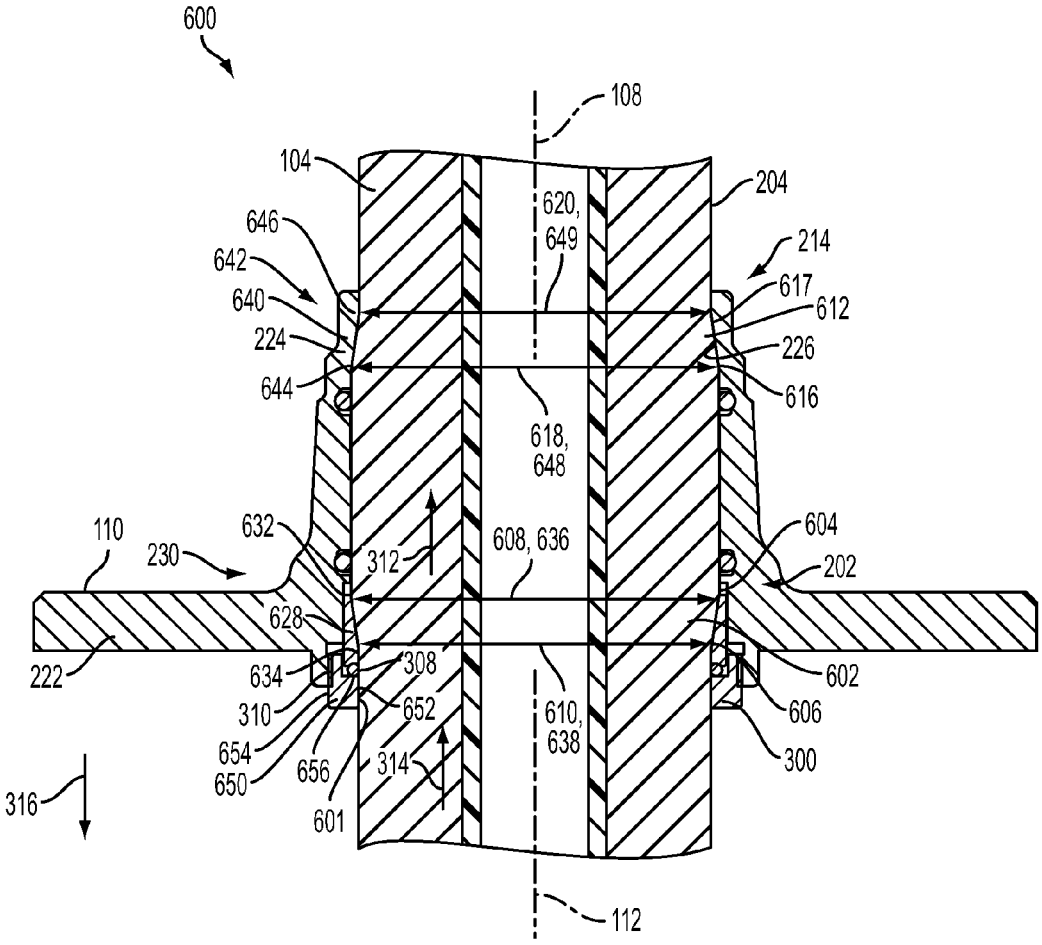
FIG. 6 illustrates an example portion of an example insulating device.

Turning to FIG. 6, a second example insulating device 600 is illustrated. The second insulating device 600 is similar in some respects to the insulating device 100 illustrated and described with respect to FIGS. 1 to 5. For example, the second insulating device 600 can include the body portion 104 extending along the body axis 108, the conduit 106, the flange portion 110 extending along the flange axis 112, etc.

In this example, the body portion 104 can include a first surface feature 602. The first surface feature 602 is positioned at the first location 202 along the body axis 108. The first surface feature 602 can be formed at the outer surface 204 of the body portion 104, such that the first surface feature 602 can engage the flange portion 110 (e.g., in particular, by engaging a first mating portion 628).

The first surface feature 602 can extend between a first surface end 604 and a second surface end 606 along the body axis 108. The first surface end 604 of the first surface feature 602 can define a first surface cross-sectional size 608. The second surface end 606 of the first surface feature 602 can define a second surface cross-sectional size 610. In this example, the second surface cross-sectional size 610 is less than the first surface cross-sectional size 608. As such, the first surface feature 602 has a generally tapered shape with a decreasing cross-sectional size from the first surface end 604 to the second surface end 606. In some examples, such as in the example of FIG. 6, the outer surface 204 of the first surface feature 602 can be generally linear in cross-section, while in other examples, the outer surface 204 may have at least some degree of curvature between the first surface end 604 and the second surface end 606.

The body portion 104 can include a second surface feature 612. The second surface feature 612 is positioned at the second location 214 along the body axis 108. The second surface feature 612 can be formed at the outer surface 204 of the body portion 104, such that the second surface feature 612 can engage the flange portion 110.

The second surface feature 612 can extend between a third surface end 616 and a fourth surface end 617 along the body axis 108. The third surface end 616 can define a third surface cross-sectional size 618. The fourth surface end 617 can define a fourth surface cross-sectional size 620. In this example, the fourth surface cross-sectional size 620 is less than the third surface cross-sectional size 618. As such, the second surface feature 612 has a generally tapered shape with a decreasing cross-sectional size from the third surface end 616 to the fourth surface end 617. In some examples, such as in the example of FIG. 6, the outer surface 204 of the second surface feature 612 can be generally linear in cross-section.

In the illustrated example, the surface ends are arranged axially along the body axis 108 from the first end 120 to the second end 122 in the order of (e.g., from bottom to top) the second surface end 606, the first surface end 604, the third surface end 616 and the fourth surface end 617. For example, the first surface end 604 is located between the second surface end 606 and the third surface end 616. The third surface end 616 may be located between the first surface end 604 and the fourth surface end 617. In this example, the mating ends are arranged axially along the body axis 108 from the first end 120 to the second end 122 in the order of (e.g., from bottom to top) the second mating end 234, the first mating end 232, the third mating end 244, and the fourth mating end 246.

Turning now to the flange portion 110, the flange portion 110 can include the fastening portion 222 and the flange wall 224. The flange wall 224 can be attached to and/or formed with the fastening portion 222. The flange wall 224 defines the flange opening 226 into which the body portion 104 is received.

The flange portion 110 is associated with the first mating portion 628 at the first location 230 along the flange axis 112. The first mating portion 628 can engage and contact the first surface feature 602 of the body portion 104. In this example, the first mating portion 628 extends between a first mating end 632 and a second mating end 634. It will be appreciated that in this example, the first mating portion 628 can be separate from the flange wall 224. For example, the first mating portion 628 comprises a structure that can separately attach to, engage, contact, etc. the inner surface of the flange wall 224. In other examples, however, the first mating portion 628 can be fixed to, formed with, etc. the flange wall 224.

The first mating end 632 of the first mating portion 628 can define a first mating cross-sectional size 636. The second mating end 634 of the first mating portion 628 can define a second mating cross-sectional size 638. In this example, the second mating cross-sectional size 638 may be less than the first mating cross-sectional size 636. As such, the first mating portion 628 has a generally tapered shape with a decreasing cross-sectional size from the first mating end 632 to the second mating end 634. In some examples, such as in the example of FIG. 6, an inner surface of the first mating portion 628 can be generally linear in cross-section, while in other examples, the inner surface may have at least some degree of curvature between the first mating end 632 and the second mating end 634.

In this example, the first surface feature 602 and the first mating portion 628 can have a generally matching shape. For example, the first mating cross-sectional size 636 may be substantially equal to the first surface cross-sectional size 608. In this example, the second mating cross-sectional size 638 may be substantially equal to the second surface cross-sectional size 610. Alternatively, the mating cross-sectional sizes 636, 638 may not be equal to the corresponding surface cross-sectional sizes 608, 610, but, rather, may be dimensioned such that the opening angle of the tapered surface of the surface feature 602 is substantially equal to the opening angle of the tapered surface of the mating portion 628.

The flange wall 224 of the flange portion 110 comprises a second mating portion 640 at the second location 642 along the flange axis 112. The second mating portion 640 can engage and contact the second surface feature 612 of the body portion 104. In this example, the second mating portion 640 extends between a third mating end 644 and a fourth mating end 646.

The third mating end 644 can define a third mating cross-sectional size 648. The fourth mating end 646 can define a fourth mating cross-sectional size 649. In this example, the fourth mating cross-sectional size 649 may be less than the third mating cross-sectional size 648. As such, the second mating portion 640 has a generally tapered shape with a decreasing cross-sectional size from the third mating end 644 to the fourth mating end 646. In some examples, such as in the example of FIG. 6, an inner surface of the second mating portion 640 can be generally linear in cross-section, while in other examples, the inner surface may have at least some degree of curvature between the third mating end 644 and the fourth mating end 646.

In this example, the second surface feature 612 and the second mating portion 640 can have a generally matching shape. For example, the third mating cross-sectional size 648 may be substantially equal to the third surface cross-sectional size 618. In this example, the fourth mating cross-sectional size 649 may be substantially equal to the fourth surface cross-sectional size 620. Alternatively, the mating cross-sectional sizes 648, 649 may not be equal to the corresponding surface cross-sectional sizes 618, 620, but, rather, may be dimensioned such that the opening angle of the tapered surface of the surface feature 612 is substantially equal to the opening angle of the tapered surface of the second mating portion 640. It will be appreciated that the cross-sectional sizes 608, 610, 618, 620, 636, 638, 648, 649 described herein comprise any number of measurements, including diameters (e.g., for when the body portion 104 and the flange portion 110 are generally axisymmetric), distances across (e.g., for when the body portion 104 and the flange portion 110 are generally square/rectangular), area, etc. In this example, the cross-sectional sizes 608, 610, 618, 620, 636, 638, 648, 649 may include a diameter.

The second insulating device 600 can include an attachment structure 650 for attaching the flange portion 110 and the body portion 104. The attachment structure 650 defines an attachment opening 601 into which the body portion 104 is received. In this example, the attachment structure 650 can have a generally matching cross-sectional shape (e.g., axisymmetric) as the body portion 104.

The attachment structure 650 can include a first side 652, a second side 654 and a third side 656. In this example, the first side 652 of the attachment structure 650 can engage the body portion 104. In this example, the second side 654 and the third side 656 can engage the flange portion 110. The attachment structure 650 can be positioned in proximity to the second mating end 634 of the first mating portion 628, with the third compression structure 308 positioned between the attachment structure 650 and the second mating end 634. By being in proximity to, it is to be appreciated that the attachment structure 650 need not be in direct contact with the second mating end 634 and, instead, one or more structures (e.g., O-rings, compression devices, etc.) may be positioned between the attachment structure 650 and the second mating end 634. In this example, a compression structure (e.g., the third compression structure 308) can be positioned between the second mating end 634 of the first mating portion 628 and the attachment structure 650.

The second side 654 of the attachment structure 650 can be attached to the flange portion 110. The attachment structure 650 can be attached in any number of ways. In the illustrated example, the second side 654 of the attachment structure 650 can threadingly engage 310 (location of threading engagement illustrated) the flange portion 110. To allow for this threading engagement 310, the second side 654 of the attachment structure 650 can include a male screw threading while the flange portion 110 can include a female screw threading. The attachment structure 650 can therefore be screwed into the flange portion 110.

In operation, the attachment structure 650 can threadingly engage 310 the flange portion 110. The attachment structure 650 can exert the force 312 (illustrated generically/schematically with arrowhead) upon the compression structure 308 and, indirectly, upon the first mating portion 628 in a direction along the body axis 108. Due to this force, the attachment structure 650 can promote engagement of the first mating portion 628 with the first surface feature 602. For example, the attachment structure 650, while threadingly engaging 310 the flange portion 110, can at least one of: move the body portion 104 in the first direction 314 along the body axis 108 or move the flange portion 110 in the second direction 316 along the body axis 108, opposite the first direction 314 to promote engagement of the first mating portion 628 with the first surface feature 602.

In response to this force (e.g., along the first direction 314 and/or the second direction 316), the third compression structure 308 tends to be compressed between the attachment structure 650 and the second mating end 634 of the first mating portion 628. As such, the attachment structure 650, when tightened to a defined torque, and the third compression structure 308 tend to provide a consistent force leading to a consistent amount of friction between the flange portion 110 and the body portion 104 and between the body portion 104 and the third compression structure 308. While there may still be some variation in force applied to the third compression structure 308 (e.g., due to variations in surface roughness, lubrication of mating parts, etc.), this variation in force is reduced. An additional benefit/advantage is that by pressing the first mating portion 628, the flange portion 110 can fit fixed independently of dimensional tolerances of the body portion 104.

Figure 7:
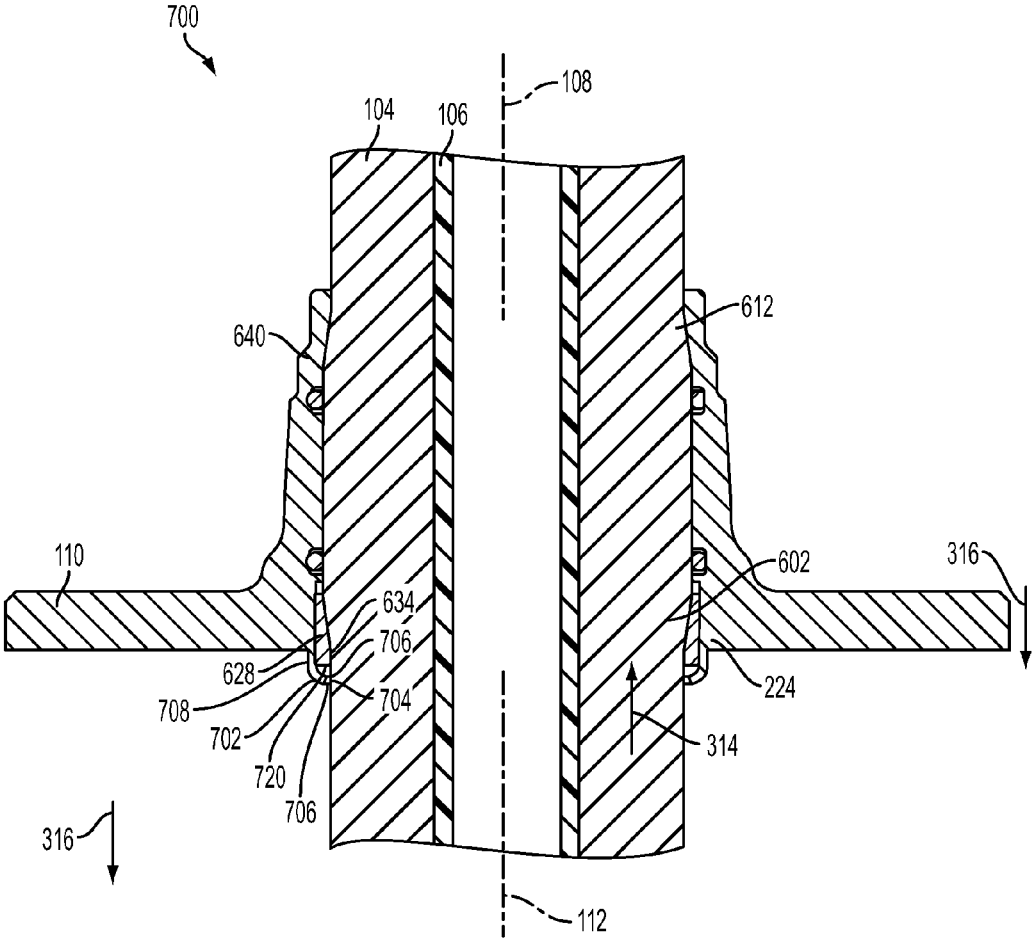
FIG. 7 illustrates an example portion of an example insulating device.

Turning to FIG. 7, a third example insulating device 700 is illustrated. The third insulating device 700 is similar in some respects to the insulating device 100 and the second insulating device 600 illustrated and described with respect to FIGS. 1-6. For example, the third insulating device 700 can include the body portion 104 extending along the body axis 108, the conduit 106, the flange portion 110 extending along the flange axis 112, etc. Likewise, the third insulating device 700 can include the first surface feature 602, the second surface feature 612, the first mating portion 628, and the second mating portion 640.

The third insulating device 700 can include an attachment structure 702 for attaching the flange portion 110 and the body portion 104. In this example, the attachment structure 702 can be formed with/fixed to the flange portion 110. The attachment structure 702 can define an attachment opening 704 into which the body portion 104 is received. In this example, the attachment structure 702 can have a generally matching cross-sectional shape (e.g., axisymmetric) as the body portion 104.

The attachment structure 702 can include a first side 706 and a second side 708. Together, the first side 706 and the second side 708 can contain the first mating portion 628. As such, the attachment structure 702 can support the flange portion 110 with respect to the body portion 104 (e.g., by containing the first mating portion 628) to limit movement (e.g., axial movement) of the flange portion 110 with respect to the body portion 104.

The second side 708 of the attachment structure 702 can engage the flange wall 224 of the flange portion 110. In this example, by engaging the flange wall 224 of the flange portion 110, the second side 708 of the attachment structure 702 can be formed with/fixed/attached to the flange wall 224. The attachment structure 702 can be positioned adjacent a surface 720 of the second mating end 634. By being adjacent, it is to be appreciated that the attachment structure 702 need not be in direct contact with the surface 720 and, instead, one or more structures (e.g., O-rings, compression devices, etc.), and/or gaps/spaces (as illustrated) may be positioned between the second mating end 634 of the first mating portion 628 and the attachment structure 702. As with the previous examples, the attachment structure 702 can at least one of: move the body portion 104 in the first direction 314 along the body axis 108 or move the flange portion 110 in the second direction 316 along the body axis 108, opposite the first direction 314 to promote engagement of the first mating portion 628 with the first surface feature 602.

Figure 8:
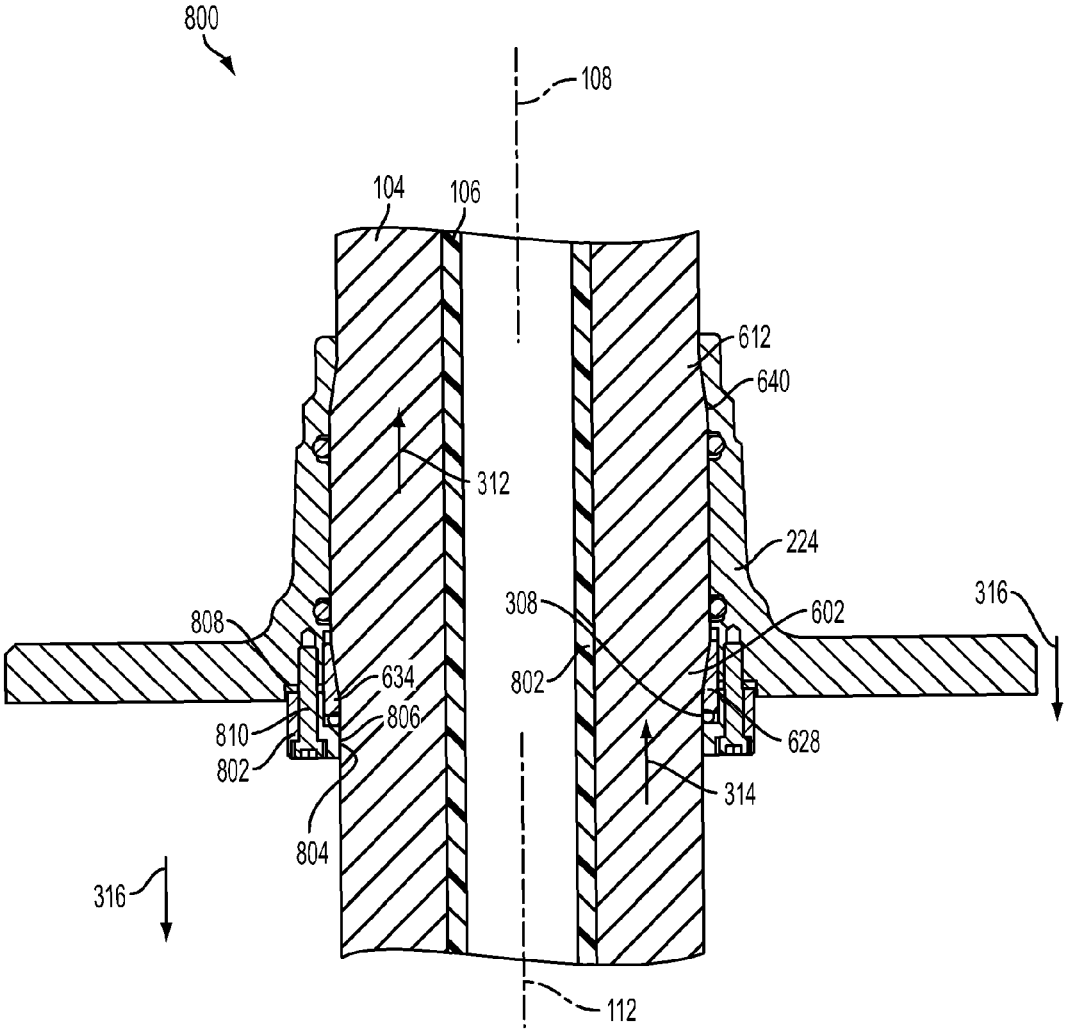
FIG. 8 illustrates an example portion of an example insulating device.

Turning to FIG. 8, a fourth example insulating device 800 is illustrated. The fourth insulating device 800 is similar in some respects to the insulating device 100, the second insulating device 600, and the third insulating device 700 illustrated and described with respect to FIGS. 1-7. For example, the fourth insulating device 800 can include the body portion 104 extending along the body axis 108, the conduit 106, the flange portion 110 extending along the flange axis 112, etc. Likewise, the fourth insulating device 800 can include the first surface feature 602, the second surface feature 612, the first mating portion 628, and the second mating portion 640.

The fourth insulating device 800 can include an attachment structure 802 for attaching the flange portion 110 and the body portion 104. In this example, the attachment structure 802 can be attached to the flange portion 110. The attachment structure 802 can define an attachment opening 804 into which the body portion 104 is received. In this example, the attachment structure 802 can have a generally matching cross-sectional shape (e.g., axisymmetric) as the body portion 104.

The attachment structure 802 can include a first side 806 and a second side 808. Together, the first side 806 and the second side 808 can contain the first mating portion 628. As such, the attachment structure 802 can support the flange portion 110 with respect to the body portion 104 (e.g., by containing the first mating portion 628) to limit movement (e.g., axial movement) of the flange portion 110 with respect to the body portion 104.

The second side 808 of the attachment structure 802 can engage the flange wall 224 of the flange portion 110. In this example, by engaging the flange wall 224 of the flange portion 110, the second side 808 of the attachment structure 802 can be attached to the flange wall 224. The second side 808 of the attachment structure 802 can be attached to the flange wall 224 with a fastener 810 in any number of ways.

In the illustrated example, the fastener 810 comprises a screw, bolt, etc. and can threadingly engage the attachment structure 802 and the flange wall 224 of the flange portion 110. As such, the fastener 810 can threadingly engage the flange portion 110. Such a method of fastening is not intended to be limiting, as any number of ways are envisioned. For example, the fastener 810 may instead include adhesives, welding attachment, other types of mechanical fasteners, snap fit/locking structures or the like.

The attachment structure 802 can be positioned adjacent the second mating end 634 of the first mating portion 628. By being adjacent, it is to be appreciated that the attachment structure 802 need not be in direct contact with the second mating end 634 and, instead, one or more structures (e.g., O-rings, compression devices, etc.) may be positioned between the second mating end 634 of the first mating portion 628 and the attachment structure 802. In this example, the compression structure 308 may be positioned between the second mating end 634 and the attachment structure 802.

In operation, the fastener 810 can threadingly engage the flange portion 110. The attachment structure 802 can exert the force 312 (illustrated generically/schematically with arrowhead) upon the compression structure 308 and indirectly upon the first mating portion 628 in a direction along the body axis 108. Due to this force, the attachment structure 802 can promote engagement of the first mating portion 628 with the first surface feature 602. For example, the attachment structure 802, while fastened with the fastener 810 to the flange portion 110, can at least one of: move the body portion 104 in the first direction 314 along the body axis 108 or move the flange portion 110 in the second direction 316 along the body axis 108, opposite the first direction 314 to promote engagement of the first mating portion 628 with the first surface feature 602.

Figure 9:
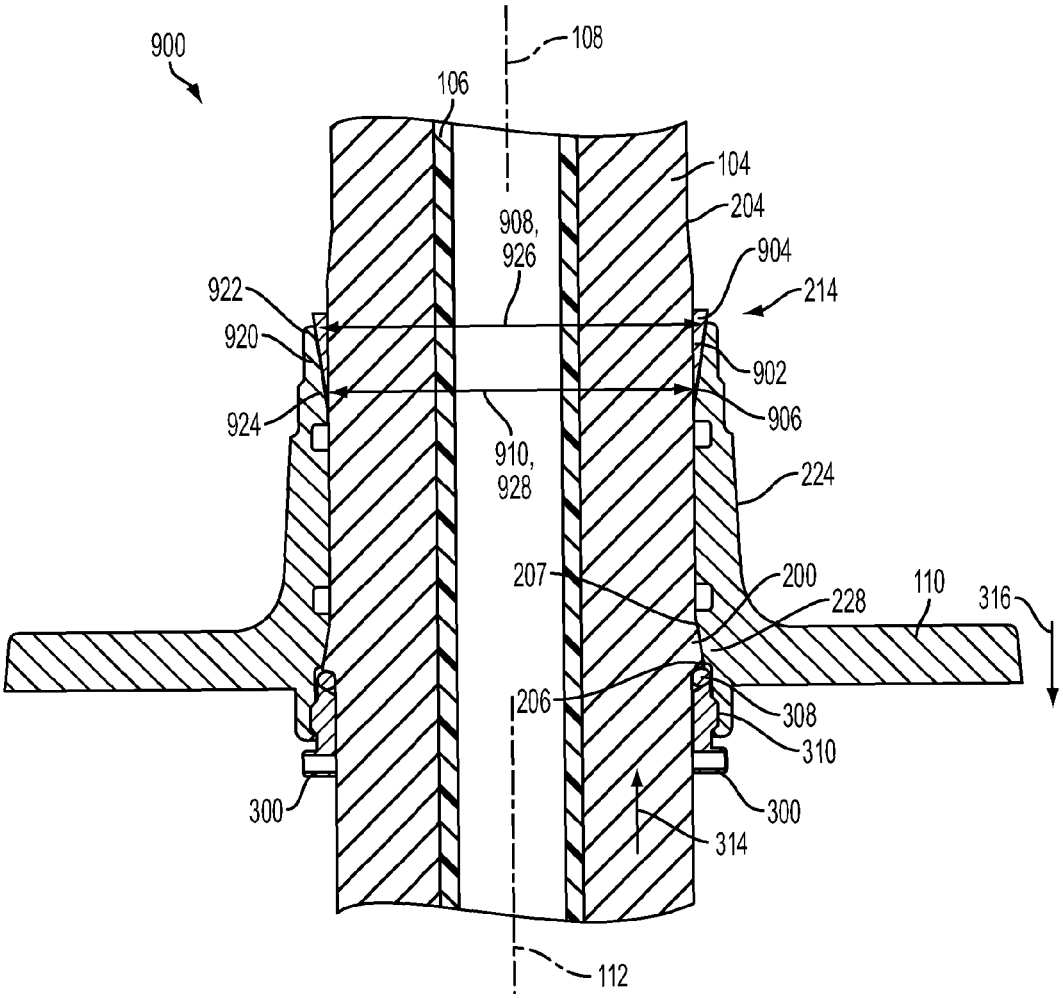
FIG. 9 illustrates an example portion of an example insulating device.

Turning to FIG. 9, a fifth example insulating device 900 is illustrated. The fifth insulating device 900 is similar in some respects to the insulating device 100 illustrated and described with respect to FIGS. 1 to 5. For example, the fifth insulating device 900 can include the body portion 104 extending along the body axis 108, the conduit 106, the flange portion 110 extending along the flange axis 112, the first surface feature 200, the first mating portion 228, the attachment structure 300, etc. The first surface feature 200 can extend between a first surface end 206 and a second surface end 207 along the body axis 108.

In this example, the body portion 104 can be associated with a second surface feature 902. The second surface feature 902 can have a wedge shape (e.g., triangular shape with an inclined plane) and can be separated (e.g., a separate component) from the body portion 104. The second surface feature 902 is positioned at the second location 214 along the body axis 108. In this example, the second surface feature 902 can be separate from the outer surface 204 of the body portion 104. For example, the second surface feature 902 comprises a structure (e.g., wedge shaped structure) that can separately attach to, engage, contact, abut, etc. the outer surface 204 of the body portion 104.

The second surface feature 902 can extend between a third surface end 904 and a fourth surface end 906 along the body axis 108. The third surface end 904 can define a third surface cross-sectional size 908. The fourth surface end 906 can define a fourth surface cross-sectional size 910. In this example, the fourth surface cross-sectional size 910 is less than the third surface cross-sectional size 908. As such, the second surface feature 902 has a generally tapered shape with a decreasing cross-sectional size from the third surface end 904 to the fourth surface end 906. In some examples, the outer surface 204 of the second surface feature 902 can be generally linear in cross-section (as illustrated), while in other examples, the outer surface 204 may have at least some degree of curvature between the third surface end 904 and the fourth surface end 906.

The flange wall 224 of the flange portion 110 comprises a second mating portion 920 at the second location 242 along the flange axis 112. The second mating portion 920 can engage and contact the second surface feature 902. In this example, the second mating portion 920 extends between a third mating end 922 and a fourth mating end 924.

The third mating end 922 of the second mating portion 920 can define a third mating cross-sectional size 926. The fourth mating end 924 of the second mating portion 920 can define a fourth mating cross-sectional size 928. In this example, the fourth mating cross-sectional size 928 may be less than the third mating cross-sectional size 926. As such, the second mating portion 920 has a generally tapered shape with a decreasing cross-sectional size from the third mating end 922 to the fourth mating end 924. In some examples, an inner surface of the second mating portion 920 can be generally linear in cross-section (as illustrated), while in other examples, the inner surface may have at least some degree of curvature between the third mating end 922 and the fourth mating end 924.

In the illustrated example, the surface ends are arranged along the body axis 108 in the order of (e.g., from bottom to top) the first surface end 206, the second surface end 207, the fourth surface end 906 and the third surface end 904. For example, the second surface end 207 is located between the first surface end 206 and the fourth surface end 906. The fourth surface end 906 may be located between the second surface end 207 and the third surface end 904. In this example, the mating ends are arranged axially along the body axis 108 from the first end 120 to the second end 122 in the order of (e.g., from bottom to top) the first mating end 232, the second mating end 234, the fourth mating end 924, and the third mating end 922.

In this example, the second surface feature 902 and the second mating portion 920 can have a generally matching shape. For example, the third mating cross-sectional size 926 may be substantially equal to the third surface cross-sectional size 908. In this example, the fourth mating cross-sectional size 928 may be substantially equal to the fourth surface cross-sectional size 910. Alternatively, the mating cross-sectional sizes 926, 928 may not be equal to the corresponding surface cross-sectional sizes 908, 910, but, rather, may be dimensioned such that the opening angle of the tapered surface of the second surface feature 902 is substantially equal to the opening angle of the tapered surface of the second mating portion 920.

With the flange portion 110 engaging the body portion 104 as described above, the attachment structure 300 can threadingly engage 310 the flange portion 110 to promote engagement of the first mating portion 228 and the first surface feature. The attachment structure 300, when tightened to a defined torque, and the compression structure 308 can provide a consistent force leading to a consistent amount of friction between the flange portion 110 and the body portion 104 and between the body portion 104 and the third compression structure 308.

Additionally, due to the first mating portion 228 engaging the first surface feature 200 and the second mating portion 920 engaging the second surface feature 902, movement between the body portion 104 and the flange portion 110 is reduced. For example, as the flange portion 110 receives the body portion 104, the respective surface features 200, 902 can engage and contact the respective mating portions 228, 920. Due to the tapered shape of the surface features 200, 902 and the mating portions 228, 920, movement of the body portion 104 with respect to the flange portion 110 is reduced. An additional benefit/advantage is that by pressing the first mating portion 228, the flange portion 110 can fit fixed independently of dimensional tolerances of the body portion 104.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing at least some of the claims.

As used in this application, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application are generally be construed to mean "one or more" unless specified otherwise or clear from context to be directed to a singular form. Also, at least one of A and B and/or the like generally means A or B and/or both A and B. Furthermore, to the extent that "includes", "having", "has", "with", or variants thereof are used, such terms are intended to be inclusive in a manner similar to the term "comprising".

Many modifications may be made to the instant disclosure without departing from the scope or spirit of the claimed subject matter. Unless specified otherwise, "first," "second," or the like are not intended to imply a temporal aspect, a spatial aspect, an ordering, etc. Rather, such terms are merely used as identifiers, names, etc. for features, elements, items, etc. For example, a first component and a second component generally correspond to component A and component B or two different or two identical components or the same component.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. An insulating device comprising:

a body portion extending along a body axis, the body portion comprising:

a first surface feature, at a first location along the body axis, extending between a first surface end and a second surface end, the first surface end defining a first surface cross-sectional size, the second surface end defining a second surface cross-sectional size, wherein the second surface cross-sectional size is less than the first surface cross-sectional size; and a second surface feature, at a second location along the body axis, extending between a third surface end and a fourth surface end, the third surface end defining a third surface cross-sectional size, the fourth surface end defining a fourth surface cross-sectional size, wherein the fourth surface cross-sectional size is less than the third surface cross-sectional size;

a flange portion extending along a flange axis that is substantially parallel to the body axis, the flange portion comprising a flange wall defining a flange opening into which the body portion is received, the flange wall of the flange portion comprising:

a first mating portion at a first location along the flange axis, the first mating portion configured to engage the first surface feature of the body portion; and a second mating portion at a second location along the flange axis, the second mating portion configured to engage the second surface feature of the body portion; and an attachment structure defining an attachment opening into which the body portion is received, a first side of the attachment structure configured to engage the body portion, a second side of the attachment structure configured to engage the flange portion, wherein the attachment structure is configured to promote engagement of the first mating portion with the first surface feature.

2. The insulating device of claim 1, wherein the attachment structure is positioned adjacent a surface of the first surface end.

3. The insulating device of claim 1, wherein the attachment structure is positioned adjacent a surface of the second surface end.

4. An insulating device comprising:

a body portion extending along a body axis, the body portion comprising:

a first surface feature, at a first location along the body axis, extending between a first surface end and a second surface end, the first surface end defining a first surface cross-sectional size, the second surface end defining a second surface cross-sectional size, wherein the second surface cross-sectional size is less than the first surface cross-sectional size; and a second surface feature, at a second location along the body axis, extending between a third surface end and a fourth surface end, the third surface end defining a third surface cross-sectional size, the fourth surface end defining a fourth surface cross-sectional size, wherein the fourth surface cross-sectional size is less than the third surface cross-sectional size; and a flange portion extending along a flange axis that is substantially parallel to the body axis, the flange portion comprising a flange wall defining a flange opening into which the body portion is received, the flange wall of the flange portion comprising:

a first mating portion at a first location along the flange axis, the first mating portion configured to engage the first surface feature of the body portion; and a second mating portion at a second location along the flange axis, the second mating portion configured to engage the second surface feature of the body portion;

wherein the body portion has an outer surface comprising a first projection portion, the first projection portion projecting in a projection direction that is substantially perpendicular to the body axis; and wherein an inner surface of the flange wall defines a first projection opening, the first projection opening of the flange portion receiving the first projection portion of the body portion when the body portion is received within the flange opening of the flange portion such that rotational movement of the flange portion with respect to the body portion about the flange axis and rotational movement of the body portion with respect to the flange portion about the body axis is limited.

5. An insulating device comprising:

a body portion extending along a body axis, the body portion comprising:

a first surface feature, at a first location along the body axis, extending between a first surface end and a second surface end, the first surface end defining a first surface cross-sectional size, the second surface end defining a second surface cross-sectional size, wherein the second surface cross-sectional size is less than the first surface cross-sectional size, the first surface feature defining a first outer surface that extends substantially linearly between the first surface end and the second surface end; and a flange portion extending along a flange axis that is substantially parallel to the body axis, the flange portion comprising a flange wall defining a flange opening into which the body portion is received, the flange wall of the flange portion comprising:

a first mating portion at a first location along the flange axis, the first mating portion configured to engage the first surface feature of the body portion.

6. The insulating device of claim 5, wherein the first mating portion extends between a first mating end and a second mating end, the first mating end of the first mating portion defining a first mating cross-sectional size, the second mating end of the first mating portion defining a second mating cross-sectional size, wherein the second mating cross-sectional size is less than the first mating cross-sectional size.

7. The insulating device of claim 6, wherein the first mating cross-sectional size is substantially equal to the first surface cross-sectional size, the second mating cross-sectional size is substantially equal to the second surface cross-sectional size.

8. The insulating device of claim 6, the flange portion comprising a second mating portion at a second location along the flange axis, the second mating portion configured to engage a second surface feature of the body portion, wherein the second mating portion extends between a third mating end and a fourth mating end, the third mating end of the second mating portion defining a third mating cross-sectional size, the fourth mating end of the second mating portion defining a fourth mating cross-sectional size, wherein the fourth mating cross-sectional size is less than the third mating cross-sectional size.

9. The insulating device of claim 8, wherein the mating ends are arranged axially from a first end to a second end of the body portion in order of the first mating end, the second mating end, the third mating end, and the fourth mating end.

10. The insulating device of claim 8, wherein the mating ends are arranged axially from a first end to a second end of the body portion in order of the second mating end, the first mating end, the third mating end, and the fourth mating end.

11. The insulating device of claim 8, wherein the mating ends are arranged axially from a first end to a second end of the body portion in order of the first mating end, the second mating end, the fourth mating end, and the third mating end.

12. The insulating device of claim 8, wherein a first surface opening angle, defined between the first surface feature and a reference axis that is substantially parallel to the body axis, is substantially equal to a first mating opening angle, defined between the first mating portion and the reference axis.

13. The insulating device of claim 5, wherein the first surface cross-sectional size defines a maximum cross-sectional size of the body portion.

14. The insulating device of claim 5, wherein the body portion extends between a first end and a second end, the first surface end in closer proximity to the first end than the second surface end is to the first end.

15. The insulating device of claim 14, wherein a first end cross-sectional size of the body portion is substantially constant between the first end and the first surface end.

16. The insulating device of claim 14, wherein a first end cross-sectional size of the body portion is non-increasing between the first end and the first surface end.

17. The insulating device of claim 14, wherein a second end cross-sectional size of the body portion is non-increasing between the second end and the second surface end.

18. The insulating device of claim 14, wherein the flange portion is configured to receive the body portion through the flange opening such that the flange portion is configured to move with respect to the body portion along the body axis from the second end to the first surface feature.

19. The insulating device of claim 5, wherein an inner surface of an end of the flange portion is spaced a distance apart from an outer surface of the body portion to define an opening between the inner surface of the end of the flange portion and the outer surface of the body portion.

20. The insulating device of claim 19, wherein an end cross-sectional size of the inner surface of the end of the flange portion is greater than the first surface cross-sectional size of the first surface end of the first surface feature.

21. The insulating device of claim 5, comprising at least one compression structure disposed radially between the body portion and the flange portion.

22. The insulating device of claim 21, the at least one compression structure comprising a first compression structure and a second compression structure.

23. The insulating device of claim 22, the first compression structure contacting the first surface feature at an inner radial side of the compression structure.

24. The insulating device of claim 23, the first compression structure contacting the first mating portion at an outer radial side of the compression structure.

25. The insulating device of claim 22, the flange portion defining a first channel within which the first compression structure is received, the flange portion defining a second channel within which the second compression structure is received.

26. The insulating device of claim 22, the second compression structure spaced a distance apart from the first compression structure, the second compression structure contacting the body portion at a second inner radial side of the second compression structure and the flange portion at a second outer radial side of the second compression structure.

27. The insulating device of claim 5, comprising an attachment structure defining an attachment opening into which the body portion is received.

28. The insulating device of claim 27, the attachment structure configured to engage the body portion and the flange portion to attach the flange portion with respect to the body portion.

29. The insulating device of claim 28, comprising a third compression structure positioned between the attachment structure and the first mating portion.

* * * * *